US008135136B2

(12) United States Patent
Van Loon et al.

(10) Patent No.: US 8,135,136 B2
(45) Date of Patent: Mar. 13, 2012

(54) AUDIO SIGNAL ENHANCEMENT

(75) Inventors: Machiel Willem Van Loon, Valkenswaard (NL); Dirk Jeroen Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1130 days.

(21) Appl. No.: 11/574,418

(22) PCT Filed: Aug. 30, 2005

(86) PCT No.: PCT/IB2005/052829

§ 371 (c)(1),
(2), (4) Date: Feb. 28, 2007

(87) PCT Pub. No.: WO2006/027717

PCT Pub. Date: Mar. 16, 2006

(65) Prior Publication Data

US 2009/0034744 A1 Feb. 5, 2009

(30) Foreign Application Priority Data

Sep. 6, 2004 (EP) ..... 04104278

(51) Int. Cl.
*H04R 5/00* (2006.01)

(52) U.S. Cl. ..... 381/1

(58) Field of Classification Search ..... 381/1, 2, 381/17–23

See application file for complete search history.

(56) References Cited

U.S. PATENT DOCUMENTS

| | | | | |
|---|---|---|---|---|
| 6,539,357 | B1 | 3/2003 | Sinha | |
| 6,865,274 | B1 * | 3/2005 | Aarts et al. | 381/55 |
| 2002/0097880 | A1 | 7/2002 | Kirkeby | |
| 2002/0191804 | A1 | 12/2002 | Luo et al. | |
| 2003/0035553 | A1 | 2/2003 | Baumgarte et al. | |
| 2003/0219130 | A1 | 11/2003 | Baumgarte et al. | |

FOREIGN PATENT DOCUMENTS

| | | | |
|---|---|---|---|
| WO | 03090206 | A1 | 10/2003 |
| WO | 2004008806 | A1 | 1/2004 |

OTHER PUBLICATIONS

Christof Faller et al; "Efficient Representation of Spatial Audio Using Perceptual Parametrization", Media Signal Proc. Research, Agere Systems, Murray Hill, NJ, Oct. 21-24, 2001.

* cited by examiner

*Primary Examiner* — Hai Phan

(57) ABSTRACT

A device (10) for enhancing a multi-channel (e.g. stereo) audio signal has a parameter adjustment unit (13) for adjusting an original parameter (α, ILD, ICC) which represents an original inter-channel property of the audio signal. The device further comprises a processing unit (11) for processing the audio signal so as to produce an enhanced audio signal having the adjusted parameter (α', ILD', ICC'). The device allows stereo widening or other multi-channel signal enhancements without introducing artifacts.

28 Claims, 3 Drawing Sheets

AUDIO SIGNAL ENHANCEMENT

Figure 1:
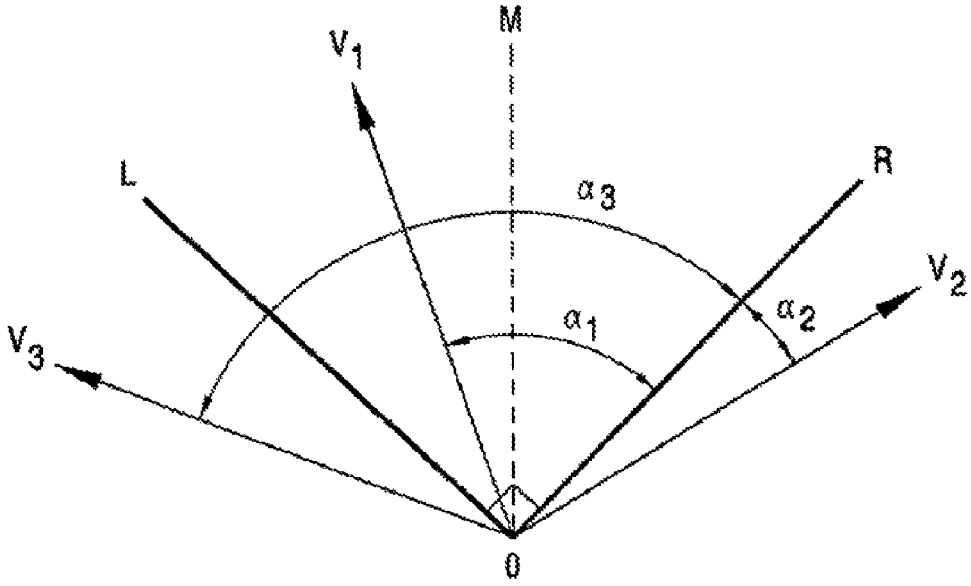

The present invention relates to audio signal enhancement. More in particular, the present invention relates to a device and a method for enhancing an audio signal comprising a first channel and a second channel.

In multi-channel audio systems, audio signals have at least two distinct channels which are rendered by separate, spaced-apart transducers. The best-known example of multi-channel audio is stereo, where two channels are used: a left channel and a right channel. When reproducing sound, the stereo effect can only be fully appreciated when the transducers are arranged symmetrically relative to the listener, with a 60 degree angle between the transducers. In practice, however, this is often not the case.

Also, the separation of the channels is often insufficient, in particular when the transducers are too close together. This is typically the case in portable and/or "mini" or "micro" (shelf size) audio systems, where the spacing between the left channel and right channel loudspeakers may be 20 cm or even less. In such situations, it is desired to "widen" the stereo effect.

U.S. Patent Application US 2002/0097880 (Kirkeby) discloses a stereo widening processing algorithm to give a listener the impression that a stereo audio signal is emanating from a virtual source spaced away from the left and right loudspeakers, thus altering the sound image. Cross-talk is introduced from the left channel to the right channel and vice versa, while filters limit the cross-talk to certain frequency ranges. However, such algorithms have the disadvantage that they introduce artifacts: they color the sound and produce changes in the relative sound levels of different sound sources, such as instruments, thus changing the sound in undesirable ways.

It is an object of the present invention to overcome these and other problems of the Prior Art and to provide a device and a method of enhancing an audio signal that allows the sound image of the various channels to be altered without distorting the signal.

Accordingly, the present invention provides a device for enhancing an audio signal comprising a first channel and a second channel, the audio signal having inter-channel properties which may be represented by parameters, the device comprising:

- parameter adjustment means for adjusting an original parameter so as to produce an adjusted parameter representing an adjusted inter-channel property, and
- processing means for processing the audio signal so as to produce an enhanced audio signal having the adjusted inter-channel property.

By providing parameter adjustment means, a different parameter value may be chosen, either relative to the original value or independently. The processing means process the original signal in such a way that the processed (enhanced) signal has the new parameter values which, in turn, represent new (that is, adjusted) inter-channel properties. By modifying signal parameters almost any adjustment of the inter-channel properties in a multi-channel system can be made without introducing artifacts.

In a first embodiment, the device of the present invention further comprises parameter determination means for determining an original parameter representing an original inter-channel property. In this embodiment, therefore, the device is capable of deriving the parameters from the audio signal. It is, however, possible to transmit one or more parameters together with the audio signal, in which case it is no longer necessary for the device to derive the transmitted parameters.

In a second embodiment, therefore, the device is arranged for receiving an original parameter representing an original inter-channel property.

Various inter-channel properties may be represented by suitable parameters. The first channel and the second channel typically define a sound source position, and the device may advantageously be arranged for adjusting the sound source position as represented by the source angle. This source angle indicates the (apparent) position of the sound source relative to the left and right channels, the source angle typically being measured relative to the right channel in a two-channel sound system. The present invention allows the source angle to be altered, thus altering the apparent position of the source.

Alternatively, or additionally, the device may be arranged for adjusting the sound source position as represented by the inter-channel level difference. This parameter, which is based on the power ratio of the channels, may be used in accordance with the present invention to change the apparent position of the source.

The first channel and the second channel typically also define a sound source width, that is, the apparent spatial extent of the sound source. The device of the present invention may also be arranged for adjusting the sound source width as represented by the inter-channel coherence.

The parameters may be adjusted or altered in various ways. In an advantageous embodiment, the parameter adjustment means are arranged for adjusting the original parameter using a mapping function, preferably a linear mapping function. Such a mapping function maps an original parameter value onto a new (adjusted) parameter value and allows a controlled adjustment.

The audio signal parameters may apply to the entire audio signal, or to only a limited frequency range of the signal. In a further embodiment, the device of the present invention is arranged for enhancing the audio signal of a selected frequency band. In this embodiment, only the selected frequency band is enhanced in a certain way, the other frequency band(s) either being left unaltered or being enhanced differently, for example using another mapping function or a different parameter.

Enhancing the audio signal may be time-independent: the selection of parameters altered or of the mapping function applied may not vary over time. However, in an alternative embodiment the device is arranged for enhancing the audio signal in dependence of time. In this embodiment, the enhancement may change over time, for example by using time-dependent mapping functions. If the audio signal is segmented into frames or similar time segments, the mapping functions or choice of parameters may be dependent on the time segment. In this way, an enhancement is obtained which is both time-dependent and signal-dependent.

The parameter adjustment may be fully automatic, following for example predetermined settings. However, the parameter adjustment means may also involve user control, so as to allow a user to adjust an angle or other parameter.

The present invention also provides an audio system comprising a device as defined above. The system may comprise at least one filter for providing frequency-dependent parameter adjustment. In an advantageous embodiment, the audio system comprises at least two filters arranged in parallel branches, and combination means for combining parameter adjusted signals from parallel branches. In such an embodiment, each branch advantageously contains a device as defined above.

Alternatively, or in addition to the filter(s) for providing frequency-dependent parameter adjustment, the audio system may comprise means for providing time-dependent parameter adjustment. Such means may include partitioning means for partitioning the audio-signal using time frames, which time frames may partially overlap. The audio system may further comprise at least one amplifier.

In a particular advantageous embodiment, the audio system is arranged for decoding a single channel signal and an associated parameter signal, and may be part of a parametric stereo decoder. It is possible to combine the left and the right channel of a stereo audio signal into a single signal while extracting the spatial information and transmitting this spatial information as an additional side signal, as disclosed in, for example, International Patent Application WO 03/090206 (Philips), the entire contents of which are hereby incorporated in this document. Decoding such a single channel audio signal and its associated parameter signal may advantageously be combined with adjusting the audio signal parameter(s) using a device of the present invention.

The audio system of the present invention may be comprised in, for example, a home cinema system or a car sound system.

The present invention additionally provides a method of enhancing an audio signal comprising a first channel and a second channel, the audio signal having inter-channel properties which may be represented by parameters, the method comprising the steps of:

adjusting an original parameter so as to produce an adjusted parameter representing an adjusted inter-channel property, and processing the audio signal so as to produce an enhanced audio signal having the adjusted inter-channel property.

Advantageously, the method of the present invention may further comprise the step of determining an original parameter representing an original inter-channel property, and/or the step of receiving an original parameter representing an original inter-channel property.

The present invention further provides a computer program product for carrying out the method as defined above. Such a computer program product may comprise processor executable code which is stored on a suitable storage medium, such as a CD or DVD, or which is available for download from a remote location, for example via the Internet.

The present invention will further be explained below with reference to exemplary embodiments illustrated in the accompanying drawings, in which:

FIG. 1 schematically shows an example of inter-channel properties of audio signal channels.

Figure 2:
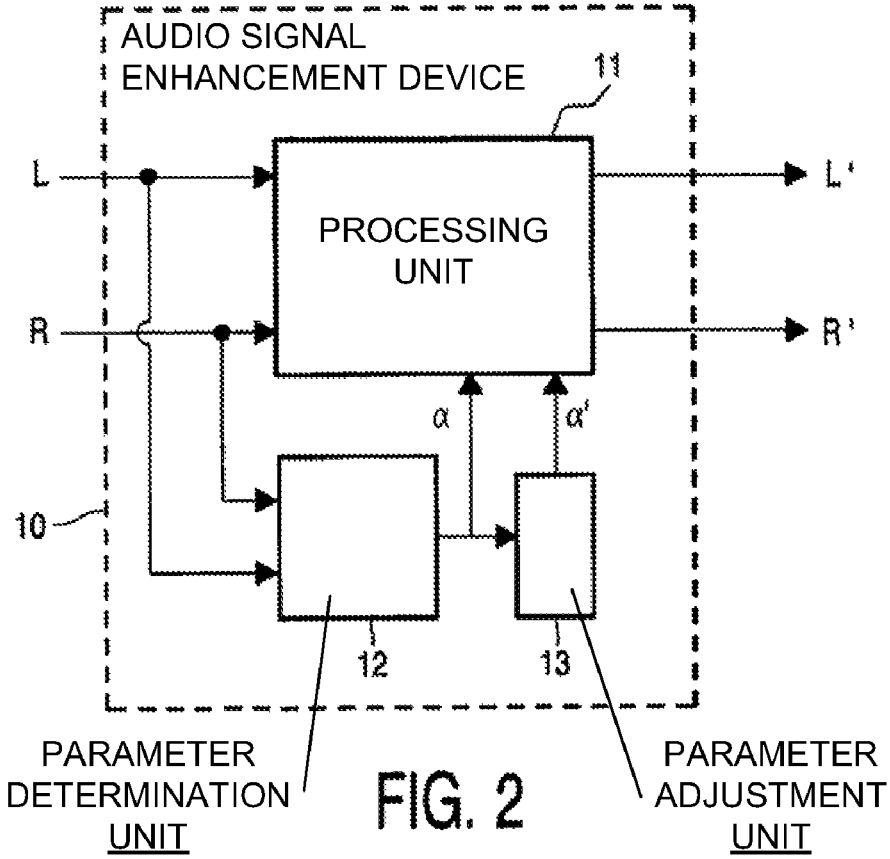

FIG. 2 schematically shows a first embodiment of a device for enhancing audio signals according to the present invention.

Figure 3:
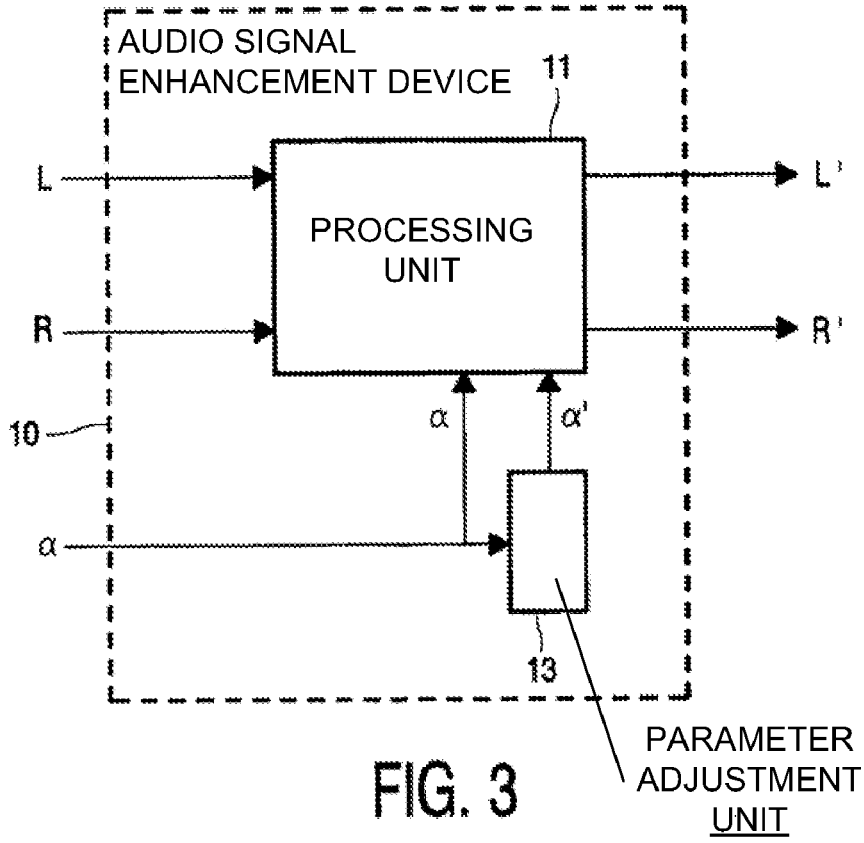

FIG. 3 schematically shows a second embodiment of a device for enhancing audio signals according to the present invention.

Figure 4:
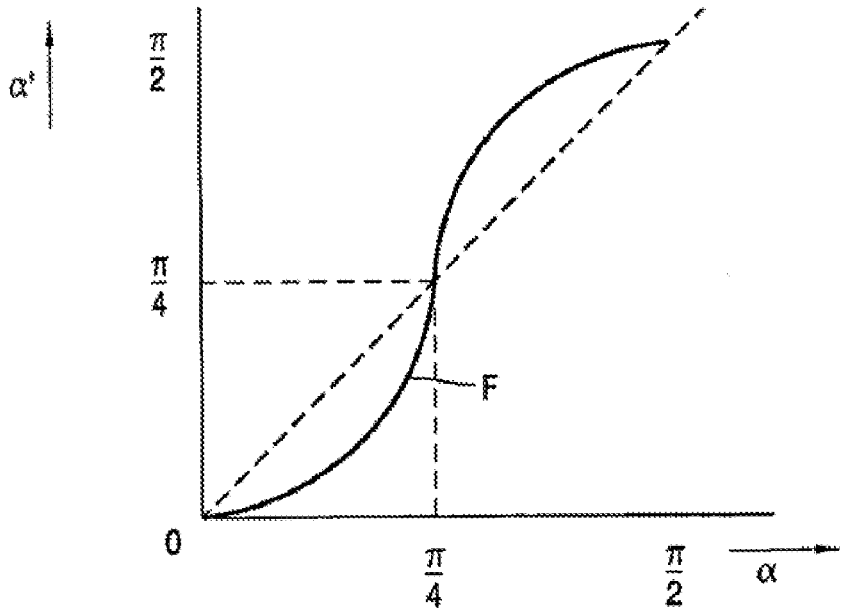

FIG. 4 schematically shows an angle transform function in accordance with the present invention.

Figure 5:
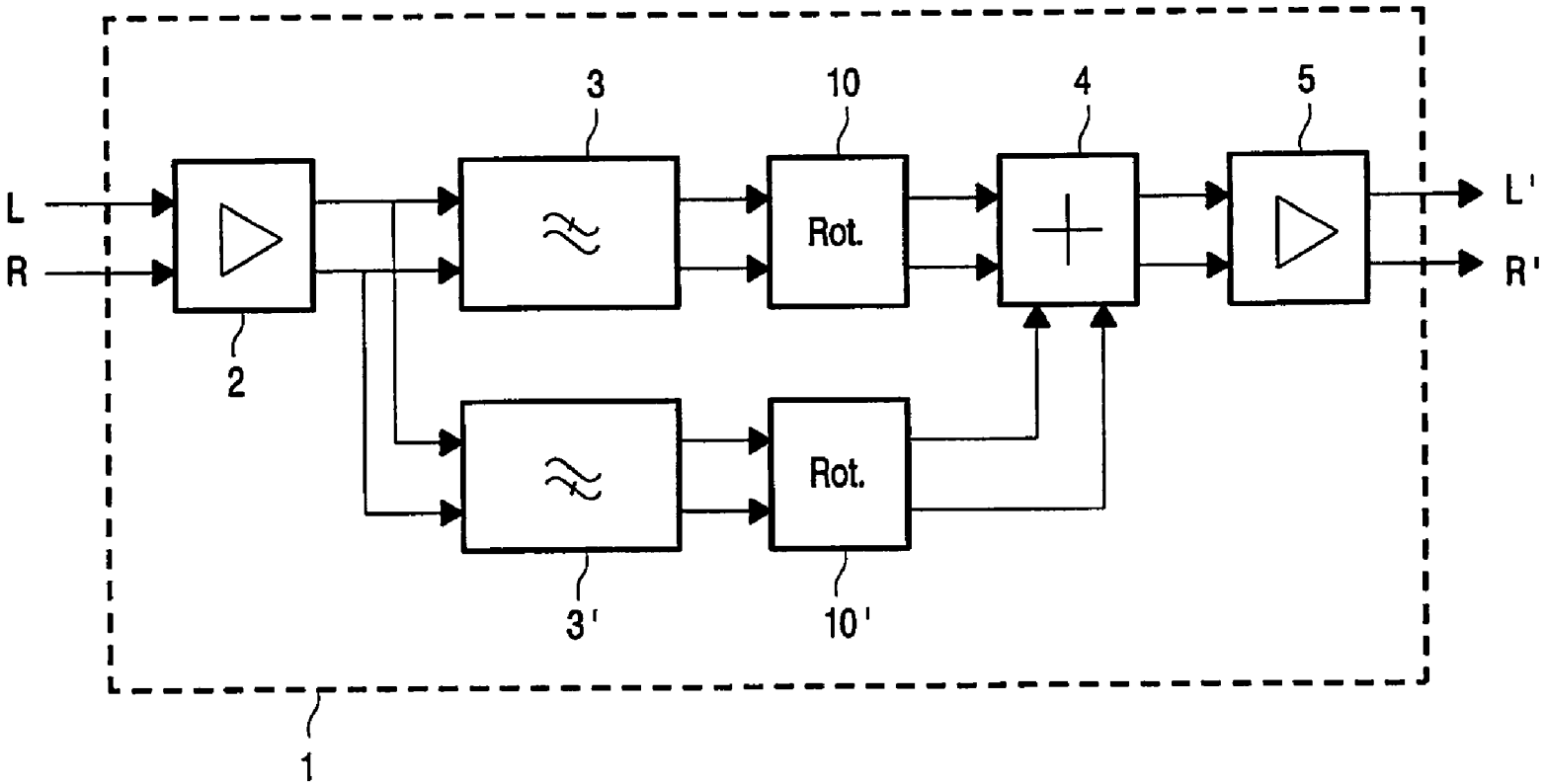

FIG. 5 schematically shows a system for enhancing sound in accordance with the present invention.

The diagram of FIG. 1 schematically represents an inter-channel audio signal property as used and modified in the present invention. An exemplary audio signal is shown to have two channels L and R. In the present example, the audio signal is a stereo signal but the present invention is not so limited and could also be applied to multi-channel audio signals, such as so-called "5.1 surround" signals. The two channels L and R of the present example are shown as orthogonal channels, defining an angle of $\pi/2$ radians (90°). It is noted that the channels L and R as represented in FIG. 1 may be interpreted as the vertical (ordinate) axis and the horizontal (abscissa) axis respectively of a co-ordinate system.

The sound produced by a stereo (or in general: multi-channel) audio signal will have an apparent position defined by the signals of the constituent channels. On average, the sound of a stereo audio signal will typically have an apparent position halfway between the left (L) and right (R) channel, at the middle indicated by the line M. It is noted that the line M has an angle $\alpha_0$ (not shown for the sake of clarity in FIG. 1) of $\pi/4$ (45°) relative to the right channel R. It is further noted that in the example of FIG. 1 the angle $\alpha$ is used to indicate the position of the apparent sound source, but that this position may also be indicated by other parameters, such as the inter-channel level difference parameter (ILD).

Any particular sound fragment, in particular when limited to a certain frequency band, may have a different orientation and hence, a different apparent position. In the example shown, the audio signal (or audio signal fragment) $V_1$ has an angle $\alpha_1$ that is larger than $\pi/4$ (45°) and consequently appears to originate from a source to the left of the middle M.

The present invention allows the angle $\alpha$ and hence the apparent position of the audio signal to be varied. More in particular, the present invention makes it possible to alter the angle $\alpha$ without coloring or otherwise distorting the signal. The angle $\alpha$ may be made to lie within the range 0 to $\pi/2$ (radians) as defined by the channels L and R, thus providing "normal" stereo. However, the present invention also allows to locate the angle $\alpha$ outside this range, thus providing "widened stereo". The audio signal (or audio signal fragment) $V_2$, for example, has a negative angle $\alpha_2$ which places the audio signal to the right of the right channel R. Similarly, the audio signal (or audio signal fragment) $V_3$ has an angle $\alpha_3$ greater than $\pi/2$, which places this audio signal to the left of the left channel L. Such "widened stereo" is particularly advantageous in smaller (portable) audio systems where a sufficient spacing of the speakers often is not possible.

An audio signal enhancement device according to the present invention is schematically illustrated in FIG. 2. The device 10 shown merely by way of non-limiting example in FIG. 2 comprises a processing unit 11, a parameter determination unit 12 and a parameter adjustment unit 13.

The processing unit 11 receives the left channel L and the right channel R of the audio signal (as mentioned above, the present invention is not limited to audio signals having only two channels) and outputs an adjusted left channel L' and an adjusted right channel R', the adjusted channels L' and R' together constituting an enhanced audio signal. The (original) left channel L and right channel R are also fed to the parameter determination unit 12 which uses these channels to produce the (original) parameters which may include the angle $\alpha$: the angle indicating the direction of the audio signal, that is, the apparent relative sound source position. This angle $\alpha$ may also be interpreted as indicating the (angle of the eigenvectors of the) principal component of the audio signal, and determining this principal component may be referred to as principal component analysis. Other parameters that may be determined by the parameter determination unit 12 include the inter-channel intensity (or: level) difference ILD and the inter-channel coherence ICC.

This angle $\alpha$, and/or other parameters, is fed to the parameter adjustment unit 13 which alters the original parameter and outputs an altered or adjusted parameter $\alpha'$, ILD' and/or ICC'. This adjusted parameter $\alpha'$, ILD' and/or ICC', and the original parameter a, ILD and/or ICC are together fed to the processing unit 11 for determining the adjusted channels L' and R'.

The operation of the device 10 will be explained with reference to an example in which the angle α will be adjusted.

The parameter determination unit 12 determines the particular angle α of the audio signal that maximizes the energy of the signal. In other words, the angle α indicates the direction in which the combined energy of the left (L) and right (R) channels are at a maximum. For audio signal fragments, this angle α will range from 0 to π/2 (0° to 90°), and will typically be approximately equal to π/4 (45°). In a preferred embodiment, the angle α is calculated using a (first) parameter called the level difference ILD which is defined mathematically as:

$$ILD = 10\log\left(\frac{\sum_k L[k]L^*[k]}{\sum_k R[k]R^*[k]}\right) \tag{1}$$

where k is the sample number (of a digital or digitized audio signal), L is the left channel, R is the right channel, log represents the logarithm base 10, and * indicates complex conjugation.

Using this parameter, the angle determination unit 12 may calculate the angle α using the formula:

$$\alpha=\arctan(c) \tag{2}$$

where $$c=10^{ILD/20} \tag{3}$$

It will be understood that for this purpose the parameter determination unit 12 may be provided with suitable processing means, such as a microprocessor with an associated memory, a special purpose integrated circuit (ASIC), or any other suitable circuit.

A more accurate determination of the angle α may be achieved when a second parameter is taken into account: the inter-channel coherence ICC. This parameter may be expressed mathematically as:

$$ICC = \left|\frac{\sum_k L[k]R^*[k]}{\sqrt{\sum_k L[k]L^*[k]\sum_k R[k]R^*[k]}}\right| \tag{4}$$

An improved version of formula (2) takes the coherence parameter ICC into account:

$$\alpha = \frac{1}{2}\arctan\left(\frac{2cICC}{c^2-1}\right) \tag{2a}$$

As stated above, this angle α is the original angle of the audio signal. The angle adjustment unit 13 of the device 10 adjusts this angle and produces an adjusted angle α'. The adjustment may be carried out in various ways. In a preferred embodiment, a transform function F is used, an example of which is illustrated in FIG. 4. A transform function may be of the form:

$$\alpha'=F(\alpha) \tag{5}$$

A function F(α) may be linear or non-linear. An example of a linear function is:

$$\alpha'=\pi/4+d.(\alpha-\pi/4) \tag{5a}$$

where d is a constant, which may be equal to, for example, 0.1, 0.5, 1.2 or 2.0. An example of a non-linear function (resembling the function F of FIG. 4) is:

$$\alpha'=\alpha-d\cdot\sin(4\alpha) \tag{5b}$$

As illustrated in the example of FIG. 4, α and α' may be identical for some values of α, such as 0, π/4 and π/2. It is not necessary for the adjusted angle α' to be equal to zero when the original angle α is equal to zero, equation (5) may well render a negative value of α' for α=0. Such a negative value would put the apparent direction of the audio signal to the right of the right-hand speaker, thus widening the stereo signal.

Instead of a fixed transform function, a variable function or a variable adjustment can be made, for example under user control. To this end, a suitable angle control signal may be fed to the angle adjustment unit 13.

The adjusted angle α' and the original angle α are both fed to the processing unit 11 so as to determine the adjusted signals L' and R'. In a preferred embodiment, the processing unit 11 first uses the original signal L[k], R[k] and the original angle α to determine a dominant signal Y[k] and a residual signal Q[k]:

$$\begin{bmatrix} Y[k] \\ Q[k] \end{bmatrix} = \begin{bmatrix} \cos\alpha & \sin\alpha \\ -\sin\alpha & \cos\alpha \end{bmatrix}\begin{bmatrix} L[k] \\ R[k] \end{bmatrix} \tag{6}$$

As usual in the field of mathematics, square brackets indicate vectors and matrices.

In accordance with the present invention, the dominant signal Y[k] and the residual signal Q[k] are then inversely rotated over an angle α' to produce the rotated (or adjusted) output signals L'[k] and R'[k]:

$$\begin{bmatrix} L'[k] \\ R'[k] \end{bmatrix} = \begin{bmatrix} \cos\alpha' & -\sin\alpha' \\ \sin\alpha' & \cos\alpha' \end{bmatrix}\begin{bmatrix} Y[k] \\ Q[k] \end{bmatrix} \tag{7}$$

The processing unit 11 may carry out this rotation operation by the above matrix multiplications, or by a combined operation which takes both formula (6) and formula (7) into account without calculating the dominant signal Y[k] and the residual signal Q[k] as intermediary results:

$$\begin{bmatrix} L'[k] \\ R'[k] \end{bmatrix} = \begin{bmatrix} \cos\alpha' & -\sin\alpha' \\ \sin\alpha' & \cos\alpha' \end{bmatrix}\begin{bmatrix} \cos\alpha & \sin\alpha \\ -\sin\alpha & \cos\alpha \end{bmatrix}\begin{bmatrix} L[k] \\ R[k] \end{bmatrix} \tag{8}$$

which may also be expressed as:

$$\begin{bmatrix} L'[k] \\ R'[k] \end{bmatrix} = \begin{bmatrix} \cos(\alpha+\alpha') & \sin(\alpha-\alpha') \\ -\sin(\alpha-\alpha') & \cos(\alpha+\alpha') \end{bmatrix}\begin{bmatrix} L[k] \\ R[k] \end{bmatrix} \tag{8a}$$

Instead of, or in addition to adjusting the angle α, it is possible to control the ICC parameter using the formulae:

$$\mu = 1 + \frac{4ICC^2-4}{\left(c+\frac{1}{c}\right)^2} \tag{9}$$

and $$\gamma = \arctan\sqrt{\frac{1-\mu}{1+\mu}} \tag{10}$$

where c is defined as in formula (3) above. By computing both the original parameters α, μ and γ, and the desired (adjusted) parameters α', μ' and γ', the values of L'[k] and R'[k] may be obtained using the expression:

$$\begin{bmatrix} L'[k] \\ R'[k] \end{bmatrix} = \begin{bmatrix} \cos\alpha' & -\sin\alpha' \\ \sin\alpha' & \cos\alpha' \end{bmatrix} \begin{bmatrix} \frac{\cos\gamma'}{\cos\gamma} & 0 \\ 0 & \frac{\sin\gamma'}{\sin\gamma} \end{bmatrix} \begin{bmatrix} Y[k] \\ Q[k] \end{bmatrix} \tag{7a}$$

Similarly, a desired value of ILD can be substituted in formula (3) to arrive at a value of c which may in turn be used in formula (9) to arrive at a new value of α, μ and, hence, of γ, which can then be used to calculate L'[k] and R'[k], as before.

The signals L' and R' resulting from formula (7) or (7a) are output by the processing unit 11 and may be fed to a set of loudspeakers, amplifiers or to other sound processing means. Those skilled in the art will appreciate that suitable D/A (Digital/Analog) converters may be provided to convert the digital signals L'[k] and R'[k] into analog signals L' and R' which may be reproduced by loudspeakers. These D/A converters may be integrated in the processing unit 11, or may be arranged in series with the unit 11.

An alternative embodiment of the device 10 according to the present invention is schematically illustrated in FIG. 3. The device of FIG. 3 also comprises a processing unit 11, and a parameter adjustment unit 13. However, in contrast to the embodiment of FIG. 2, the parameter determination unit 12 has been omitted. In this embodiment, the parameters are received together with the audio signal from an external source, as a result of which there is no need to derive the parameters in the device 10. The audio signal in this example can be said to comprise a left channel (L), a right channel (R) and a parameter channel (α, ILD, ICC).

In a further alternative embodiment (not shown) the audio signal comprises a single (mono) channel and a parameter channel. The mono channel, which contains the signal Y[k], and the parameters (e.g. α, ILD, ICC) can be used to derive the residual signal Q[k] mentioned above using an all-pass decorrelation filter.

An exemplary audio system 1 is schematically illustrated in FIG. 5. The audio system 1 shown comprises an input amplifier 2, filters 3 and 3', enhancement devices 10 and 10', a signal combination unit 4, and an output amplifier 5. A/D (Analog/Digital) converters and D/A (Digital/Analog) converters may be present but are not shown for the sake of clarity of the illustration.

The left channel L and the right channel R of an audio signal are fed to the input amplifier 2 which may contain an A/D converter as discussed above. The amplified signals are fed to a low-pass filter 3 and a high-pass filter 3' which are accommodated in parallel branches (it will be understood that these filters are exemplary only and that more or fewer filters may be present). The filtered channel signals are fed to enhancement devices 10 and 10' of the present invention which may correspond with the device 10 of FIG. 2. The devices 10 and 10' provide a rotation of the channel signals over an angle α' as discussed above.

It is noted that the embodiment of FIG. 5 allows selective enhancement (for example rotation and/or source widening or narrowing) per frequency band. The lower frequencies passed by the first filter 3 and the higher frequencies passed by the second filter 3' may have distinct original parameters with in turn may result in distinct adjusted parameters. In addition, the enhancement devices 10 and 10' may have distinct transform or mapping functions F(α, ILD, ICC, . . . ). This allows a frequency-dependent angle adjustment.

It is noted that the transform function(s) F(α, ILD, ICC, . . . ) may alternatively, or additionally, be time-dependent. For example, the channel signals L and R (when digital or digitized) may be divided into frames, each frame containing a certain number of samples, and the transform functions may be dependent on the frame number.

The signals output by the enhancement devices 10, 10' are combined by combination unit 4. This unit preferably adds the left channel signals from the devices 10, 10' to form a combined left channel signal. Similarly, the right channel signals are combined. These combined channels are then fed to an output amplifier 5 which amplifies the respective signals. The output amplifier 5 may contain a D/A converter as discussed above.

As explained above, the audio system 1 of the present invention makes a channel rotation per frequency band possible. Additionally, or alternatively, a time-dependent channel rotation may be provided, for example by making the angle adjustment dependent on the time frames (suitable means for partitioning the audio signal using time frames may be provided). In a further embodiment, a channel rotation per instrument may be provided, for example using the MIDI technology which allows individual instruments to be stored.

It will be understood that the amplifiers 2 and 5 are optional, and that more than two enhancement devices 10, 10', . . . may be provided. In addition to the components shown, other components may be comprised in the audio system, such as audio signal sources and transducers. Audio signal sources may comprise CD players, DVD players, MP3 players, radios, television sets, computers, internet terminals, local network terminals, and other sources. Transducers may include electromechanical loudspeakers, electrostatic loudspeakers, and "shakers" or other resonators. The audio system of the present invention may be utilized in home sound systems including television (home cinema) and multimedia systems, professional sound systems such as cinema sound systems, and car sound systems.

The present invention is based upon the insight that the audio signal parameters defined by sound channels may be altered using suitable techniques. The present invention benefits from the further insight that principal component analysis and related techniques allow the audio signal parameters to be manipulated without introducing artifacts.

Although the present invention has been explained with reference to stereo (that is, two channel) audio signals, the invention is not so limited and may readily be applied to multiple channel audio signals, for example "5.1" signals. The formulae used above may be applied when selecting two channels from the multiple channels, or these formulae may be adapted to the particular multiple channel situation.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A device for enhancing an audio signal comprising a first channel (L) and a second channel (R), the audio signal having inter-channel properties which may be represented by parameters of source angle (α), inter-channel level difference (ILD), and inter-channel coherence (ICC), the device comprising:

parameter adjustment means for adjusting an original parameter (α, ILD, ICC) so as to produce an adjusted parameter (α', ILD', ICC') representing an adjusted inter-channel property, and processing means, responsive to (a) both (a)(i) the original parameter and (a)(ii) the adjusted parameter together, for processing the audio signal to produce an enhanced audio signal having the adjusted inter-channel property, wherein (b) the processing means (b)(i) uses the audio signal and the original parameter to determine a dominant signal Y[k] and a residual signal Q[k] and (b)(ii) inversely rotates the dominant signal Y[k] and the residual signal Q[k] over the adjusted parameter to produce an adjusted output signal corresponding to the enhanced audio signal.

2. The device according to claim 1, further comprising parameter determination means for determining the original parameter (α, ILD, ICC) representing an original inter-channel property of the audio signal.

3. The device according to claim 1, arranged for receiving the original parameter (α, ILD, ICC) representing an original inter-channel property of the audio signal.

4. The device according to claim 1, wherein the first channel (L) and the second channel (R) define a sound source position, wherein the parameter adjusting means is further for adjusting the sound source position as represented by the source angle (α) and producing an adjusted angle (α').

5. The device according to claim 1, wherein the first channel (L) and the second channel (R) define a sound source position, wherein the parameter adjusting means is further for adjusting the sound source position as represented by the inter-channel level difference (ILD) and producing an adjusted angle (α').

6. The device according to claim 1, wherein the first channel (L) and the second channel (R) define a sound source width, wherein the parameter adjusting means is further for adjusting the sound source width as represented by the inter-channel coherence (ICC) and producing an adjusted angle (α').

7. The device according to claim 1, wherein the parameter adjustment means is arranged for adjusting the at least one original parameter (α, ILD, ICC) using a mapping function (F(α); F(ILD); F(ICC)).

8. The device according to claim 1, arranged for enhancing the audio signal of a selected frequency band.

9. The device according to claim 1, arranged for enhancing the audio signal in dependence of time.

10. The device according to claim 1, wherein the parameter adjustment means is arranged for user control.

11. An audio system comprising at least one device according to claim 1.

12. The audio system according to claim 11, further comprising at least one filter for selecting a frequency range.

13. The audio system according to claim 11, further comprising at least two filters arranged in parallel branches; and combination means for combining parameter adjusted signals from parallel branches.

14. The audio system according to claim 11, further comprising at least one amplifier.

15. The audio system according to claim 11, arranged for decoding a single channel signal and an associated parameter signal.

16. A home cinema system comprising an audio system according to claim 11.

17. A car sound system comprising an audio system according to claim 11.

18. A method of enhancing an audio signal comprising a first channel (L) and a second channel (R), the audio signal having inter-channel properties which may be represented by parameters of source angle (α), inter-channel level difference (ILD), and inter-channel coherence (ICC), the method comprising the steps of:

adjusting an original parameter (α, ILD, ICC) so as to produce an adjusted parameter (α', ILD', ICC') representing an adjusted inter-channel property, and processing the audio signal, responsive to (a) both (a)(i) the original parameter and (a)(ii) the adjusted parameter together, to produce an enhanced audio signal having the adjusted inter-channel property, wherein (b) processing comprises (b)(i) using the audio signal and the original parameter to determine a dominant signal Y[k] and a residual signal Q[k] and (b)(ii) inversely rotating the dominant signal Y[k] and the residual signal Q[k] over the adjusted parameter to produce an adjusted output signal corresponding to the enhanced audio signal.

19. The method according to claim 18, further comprising the step of determining an original parameter (α, ILD, ICC) representing an original inter-channel property.

20. The method according to claim 18, further comprising the step of receiving an original parameter (α, ILD, ICC) representing an original inter-channel property.

21. The method according to claim 18, wherein the first channel (L) and the second channel (R) define a sound source position, the method further comprising the step of adjusting the sound source position as represented by the source angle (α) and producing an adjusted angle (α').

22. The method according to claim 18, wherein the first channel (L) and the second channel (R) define a sound source position, the method further comprising the step of adjusting the sound source position as represented by the inter-channel level difference (ILD) and producing an adjusted angle (α').

23. The method according to claim 18, wherein the first channel (L) and the second channel (R) define a sound source width, the method further comprising the step of adjusting the sound source width as represented by the inter-channel coherence (ICC) and producing an adjusted angle (α').

24. The method according to claim 18, further comprising the step of adjusting the original parameter (α, ILD, ICC) using a mapping function (F(α); F(ILD); F(ICC)), wherein the mapping function comprises a linear mapping function.

25. The method according to claim 18, further comprising the step of enhancing the audio signal of a selected frequency band.

26. The method according to claim 18, further comprising the step of enhancing the audio signal in dependence of time.

27. The method according to claim 18, wherein the step of adjusting an original parameter is under user control.

28. A non-transitory computer-readable media embodied with a computer program executable by a computer for carrying out the method according to claim 18.

* * * * *